US007303299B2

(12) United States Patent
Theus

(10) Patent No.: US 7,303,299 B2
(45) Date of Patent: Dec. 4, 2007

(54) ILLUMINATED PLUMBING FIXTURES

(76) Inventor: Thomas S. Theus, 30 Beech Ave., Northfield Village, OH (US) 44067

( * ) Notice: Subject to any disclaimer, the term of this patent is extended or adjusted under 35 U.S.C. 154(b) by 104 days.

(21) Appl. No.: 11/215,095

(22) Filed: Aug. 30, 2005

(65) Prior Publication Data

US 2006/0077652 A1 Apr. 13, 2006

Related U.S. Application Data

(60) Provisional application No. 60/618,092, filed on Oct. 13, 2004.

(51) Int. Cl.
*F21V 33/00* (2006.01)

(52) U.S. Cl. ..... 362/96; 362/101; 222/113; 239/18

(58) Field of Classification Search ..... 362/96, 362/101; 222/113; 239/18
See application file for complete search history.

(56) References Cited

U.S. PATENT DOCUMENTS

| | | | |
|---|---|---|---|
| 141,619 | A | 8/1873 | Auld |
| 231,405 | A | 8/1880 | Cooke |
| 548,616 | A | 10/1895 | Porter |
| 574,335 | A | 12/1896 | Kester |
| 597,631 | A | 1/1898 | Boutilier |
| 893,082 | A | 7/1908 | Lind |
| 893,214 | A | 7/1908 | Williams et al. |
| 1,136,378 | A | 4/1915 | Sundh |
| 1,165,511 | A | 12/1915 | Jones |
| 1,225,865 | A | 5/1917 | Schneible |
| 1,230,942 | A | 6/1917 | Sundh |
| 1,425,531 | A | 8/1922 | Mabey |
| 1,674,159 | A | 6/1928 | Cruys |
| 1,841,570 | A | 1/1932 | Burkholder |
| 1,863,203 | A | 6/1932 | Lewis |
| 1,929,741 | A | 10/1933 | Hall et al. |
| 1,985,483 | A | 12/1934 | Clarke |
| 2,308,844 | A | 1/1943 | Wilshusen |
| 2,330,592 | A | 9/1943 | Kendrick |
| 2,477,984 | A | 8/1949 | Jackson |
| 2,547,450 | A | 4/1951 | DuPont |
| 2,598,357 | A | 5/1952 | Coleman |

(Continued)

OTHER PUBLICATIONS

Tiffany Marble Molds International, Inc. (Campbell, CA), "Tiffany Products and Pours", Translucent Tiff-Onyx, Aug. 27, 2004 website page: www.tiffanymarble.com/formulae.html (1 pg.).

(Continued)

*Primary Examiner*—Sandra O'Shea
*Assistant Examiner*—Jason Moon Han
(74) *Attorney, Agent, or Firm*—Dwight A. Stauffer, Pat. Agent

(57) ABSTRACT

Apparatus and method for illuminating plumbing fixtures such as spouts and controls and vessels that are fixed in place relative to a mounting surface. A light transmitting material is used for the fixture, and one or more hidden light sources are mounted inward of the mounting surface. The hidden light source may be attached or detached from the fixture and is arranged so that light from the hidden light source is received by an inward portion of the fixture, is transmitted through the fixture to its outward exposed surface, and then is emitted outward of the mounting surface. Thus the inventive fixture is illuminated from within.

8 Claims, 5 Drawing Sheets

U.S. PATENT DOCUMENTS

| | | | | | |
|---|---|---|---|---|---|
| 2,631,393 | A | | 3/1953 | Hetherington | |
| 2,676,244 | A | | 4/1954 | Dittman | |
| 2,682,251 | A | | 6/1954 | Neugass | |
| 2,746,646 | A | | 5/1956 | Hall | |
| 3,035,738 | A | | 5/1962 | Bloom | |
| 3,219,237 | A | | 11/1965 | Jackson | |
| 3,719,821 | A | | 3/1973 | Foreman | |
| 3,752,192 | A | | 8/1973 | Kleppin | |
| 3,955,075 | A | | 5/1976 | Susedik | |
| 4,241,868 | A | * | 12/1980 | Perkins | 236/12.11 |
| 4,777,570 | A | | 10/1988 | Littles | |
| 4,901,922 | A | * | 2/1990 | Kessener et al. | 239/12 |
| 5,291,378 | A | | 3/1994 | Stone | |
| 5,491,617 | A | | 2/1996 | Currie | |
| 5,586,691 | A | | 12/1996 | Gotch et al. | |
| 5,967,371 | A | | 10/1999 | Stephen | |
| 6,019,480 | A | | 2/2000 | Polkow | |
| 6,074,078 | A | | 6/2000 | Georgeff et al. | |
| 6,293,685 | B1 | | 9/2001 | Polkow | |
| 6,565,223 | B2 | | 5/2003 | Liao et al. | |
| 6,729,740 | B1 | | 5/2004 | Gazard | |
| 6,783,028 | B1 | | 8/2004 | Ambrose et al. | |
| 6,805,458 | B2 | * | 10/2004 | Schindler et al. | 362/96 |
| 7,008,073 | B2 | * | 3/2006 | Stuhlmacher, II | 362/96 |

OTHER PUBLICATIONS

LUXARIS (Huntington Valley, PA), "Glass Bowls", Item DI.I1004-B [appears to be transparent], Jun. 30, 2005 website page: www.luxaris.com/vanity_glass_bowls _vessel_sinks.asp (5 pgs.).

Beer. Beer & More Beer (Concord, CA). "D1292: Facuet Handle—Light House", Sep. 9, 2004 website page: http://www.morebeer.com/browse.html?PHPSESSID=611644d0636b477a5d4e093b955b9c91&keyword=d1292 (1 pg.).

Kohler Co. (Kohler, WT), "In the Bathroom: Sinks", K-2276 Vessels Spun Glass™ lavatory, website page: http://www.us.kohler.com/onlinecatalog/detail.jsp?from—thumb&frm=?module—Lavatories&item=175702&prod_num—2276&section=2&category—16 (1 pg), no date.

* cited by examiner

ILLUMINATED PLUMBING FIXTURES

CROSS-REFERENCE TO RELATED APPLICATIONS

This application claims the benefit of commonly owned U.S. Provisional Patent Application No. 60/618,092, filed Oct. 13, 2004 by Thomas S. Theus, and is hereby incorporated in its entirety by reference herein.

TECHNICAL FIELD OF THE INVENTION

The present invention relates to illuminated plumbing fixtures and, more particularly to dispensing spouts and associated plumbing fixtures, all being illuminated.

BACKGROUND OF THE INVENTION

Bathrooms, lavatories, water closets and the like are commonly used at night when low levels of illumination are desirable, either for functional lighting, or for mood lighting such as for a relaxing bath. Although candles may provide nice mood lighting, they are not practical for use as a "nightlight". Likewise, a standard low wattage nightlight does not provide much in the way of elegant mood lighting. Furthermore, typical nightlights are rather unattractive protrusions from an outlet in the bathroom (or lavatory, etc.). Thus there is a desire for novel bathroom lighting that is both unobtrusive and able to provide functional lighting in a way that is attractive enough to enhance the ambiance of the bathroom. The present invention approaches this challenge through unobtrusive illumination of plumbing fixtures in the bathroom, wherein the term "fixtures" is intended to include such items as water faucet spouts, their controls (handle, knob, etc.), vessels (sink bowls and bathtubs or portions thereof including trim), toilet flush valve handles, and the like.

Translucent or transparent sink bowls are known. For example, a Luxaris website (www.luxaris.com/vanity_glass-_bowls_vessel_sinks.asp, Jun. 30, 2005) offers a broad range of glass sink bowls in various translucent colors and patterns as well as clear glass. For example, Tiffany Marble Molds International, Inc. (www.tiffanymarble.com/formulae.html; Aug. 27, 2004) advertises a "translucent Tiff-Onyx sink bowl set in a Tiffany Granite countertop. A light mounted under this sink countertop combination results in a beautiful and unique night light by giving the sink a soft glow." Neither company appears to offer guidance or apparatus to implement the suggested lighting.

Illumination of faucet or tap handles (controls) has taken several forms in the prior art. U.S. Pat. No. 5,586,691 (Gotch et al.; 1996), discloses a combination dispense tap and customer information display wherein the tap handle is made of light-transparent material that is illuminated by light that is transmitted from a hidden light source, which is attached on the outside of the tap body. In an alternative embodiment a remote spotlight shines on a reflective handle. Thus the control is illuminated, but not the associated spout, and the light source is attached outside of the spout and control.

U.S. Pat. No. 5,491,617 (Currie; 1996) discloses an illuminated fluid tap wherein fiber optic cables (20, 30) transmit light from a hidden remote source into a transparent/translucent plastic tap handle (50) and to an area beyond the tap outlet (spout) for illuminating the stream of fluid. Again the control is illuminated, but not the associated spout.

U.S. Pat. No. 2,330,592 (Kendrick; 1941) discloses a nozzle illuminating means wherein a light source is attached to a handle (control) and directs light through a light pipe to the end of a nozzle for lighting the area ahead of the nozzle. Neither the spout nor control are illuminated, and the light source is attached on an outer portion of the device.

U.S. Pat. No. 6,729,740 (Gazard; 2004) discloses a door knob night light wherein a translucent or transparent door knob contains its own light source. Similarly, U.S. Pat. No. 4,777,570 (Littles; 1988) discloses an illuminated doorknob lock wherein the light source is contained in the doorknob, and U.S. Pat. No. 3,719,821 (Foreman; 1973) discloses an illuminated attachment for a lock-equipped door knob wherein the attachment contains the knob illuminating light source.

Other prior art discloses control lighting that uses light sources located remote from the lighted control. U.S. Pat. No. 6,565,223 (Liao et al.; 2003) discloses an integrated light transfer structure for providing halo and end illumination for a control switch assembly, wherein light sources (34) are hidden in a panel. A control housing (10) mounts on the panel over the light sources and conducts light to radiate throughout the control body and also out of a control knob (50). U.S. Pat. No. 3,955,075 (Susedik; 1976) discloses a doorknob illuminating device wherein a hidden light source uses a Lucite rod to transmit light to a Lucite doorknob. U.S. Pat. No. 2,682,251 (Neugass; 1951) discloses an illuminated knob wherein a transparent knob receives light piped in from behind. The knob is covered with an opaque metallic layer except for light-transmitting openings as desired, e.g., for illuminated lettering. Only a portion of the Neugass control is illuminated.

As noted above (e.g., Currie, '617; and Kendrick, '592), illumination for fluid outlets (spouts) is often in the form of light directed at or into the fluid stream or into the pouring area for lighting the receiver of the fluid emitted by the spout. This type of lighting dates back at least as far as 1873 as disclosed in the oil-can of U.S. Pat. No. 141,619 (Auld; 1873). The light source for such devices is generally located outside of a fixed mounting surface (such as a couniertop). An example of a spout that itself is lighted is disclosed by U.S. Pat. No. 2,477,984 (Jackson; 1946) which discloses an illuminated pouring spout for attachment on a bottle. The spout incorporates a decorative figure having a chamber therein provided with a light bulb, a battery and means whereby when the bottle is tipped to the pouring position the battery will contact the bulb and the decorative figure will be illuminated. It appears that the illuminated decorative figure is only a portion of the pouring spout.

None of the above prior art devices appear to provide much in the way of teaching about hidden illumination from within for a spout itself when the spout is fixedly attached to a surface (e.g., a counter).

It is an object of the present invention to provide apparatus and method for illuminating plumbing fixtures, e.g., spouts and controls that are fixed in place, in a way that overcomes the limitations and defects of the prior art. In particular, it is an object to illuminate a water spout along with its associated control(s) by using one or more hidden light source(s). It is an object to illuminate plumbing fixtures with light that is transmitted through the material of the fixture(s) for illumination from within. It is an object to illuminate an entire spout and/or control (fixture) from within, particularly using a light source that is hidden behind the mounting surface of the fixture(s).

BRIEF SUMMARY OF THE INVENTION

According to the invention, illuminated plumbing fixtures are disclosed comprising: a spout mounted on a fixed mounting surface, the spout extending outward from the mounting surface; and a hidden light source mounted inward from the mounting surface; wherein: the spout comprises a light transmitting material; and the spout has a shape and surface treatment such that light from the hidden light source is emitted outward of the mounting surface.

According to the invention, the illuminated plumbing fixtures further comprise: a control for the spout, the control also being mounted on the mounting surface, and extending outward from the mounting surface; and a hidden light source mounted inward from the mounting surface; wherein: the control comprises a light transmitting material; and the control has a shape and surface treatment such that light from the hidden light source is emitted outward of the mounting surface. Preferably the control emits light from substantially all of the control's surface that is exposed outward of the mounting surface. The illuminated plumbing fixtures may further comprise: a vessel for the spout, the vessel also being mounted on the mounting surface, and having a surface that is exposed outward of the mounting surface; and a hidden light source mounted inward from the mounting surface; wherein: at least a portion of the vessel comprises a light transmitting material; and the vessel has a shape and surface treatment such that light from the hidden light source is emitted outward of the mounting surface from the light transmitting portion of the vessel's surface that is exposed outward of the mounting surface. Preferably one hidden light source supplies light for two or more of the illuminated plumbing fixtures that are mounted on the mounting surface.

According to the invention, the illuminated plumbing fixtures further comprise a bracket that comprises: a receiving tube for holding a one of the illuminated plumbing fixtures; a flange at a first end of the receiving tube for attaching it inward of the mounting surface; and a through hole at a second end of the receiving tube, distal from the first end; wherein: the hidden light source is attached to the second end of the receiving tube radially outward from the through hole for passing light from the attached hidden light source into the receiving tube.

Alternatively according to the invention, the illuminated plumbing fixtures further comprise: a light gathering ball that comprises: a light transmitting solid ball; and a shaft receiving hole extending diametrically from the surface of the ball to a point at least part way through the ball, for holding a one of the illuminated plumbing fixtures; wherein: the hidden light source is detached from the light gathering ball but is mounted where it supplies light to a portion of the light gathering ball.

According to the invention, the spout preferably emits light from substantially all of the spout's surface that is exposed outward of the mounting surface.

According to the invention, an illuminated plumbing fixture comprises: a bent rod mounted on a fixed mounting surface, such that an outer portion of the rod including an elbow extends outward from the mounting surface, and an inner portion of the rod extends through and inward from the mounting surface; and a hidden light source mounted inward from the mounting surface; wherein: the rod comprises a light transmitting material; and the rod has a shape and surface treatment such that light from the hidden light source is emitted from the outer portion of the rod.

According to the invention, the illuminated plumbing fixture further comprises a fixture wherein the hidden light source is attached to the end of the inner portion of the rod. Preferably the hidden light source is attached to a radially outward portion of the end, thereby allowing a radially central portion of the end to be connected to other elements of a plumbing system.

According to the invention, the bent rod may be a hollow tube. Optionally a portion of the outer portion of the rod has a non-circular cross-section.

According to the invention, the illuminated plumbing fixture further comprises: a solid, light transmitting ball at the end of the inner portion of the rod; and a mounting position for the hidden light source such that the light source supplies light to a portion of the ball.

According to the invention, a method is disclosed for illuminating a plumbing fixture wherein the fixture is a spout for dispensing a fluid, or a vessel for containing a fluid, or a control for controlling flow of a fluid, and has a surface that is exposed outward from a mounting surface, the method comprising the steps of: using a light transmitting material for making the fixture; mounting the fixture on the mounting surface; extending the fixture inward of the mounting surface; mounting a hidden light source inward from the mounting surface; causing light from the hidden light source to be received by the inward portion of the fixture; and applying a shape and surface treatment to the fixture such that light received from the hidden light source is transmitted from the inward portion to the outward exposed surface and then is emitted outward of the mounting surface.

According to the invention, the method further comprises the steps of: using a bracket inward from the mounting surface to attach the fixture to the mounting surface; and attaching the hidden light source to a portion of the bracket such that it does not block connection of the fixture and conventional plumbing elements that are associated with the fixture.

According to the invention, the method further comprises the steps of: indirectly attaching the fixture to the mounting surface by using a fixedly mounted conventional plumbing element that is associated with the fixture; and using a light transmitting ball around the inward portion of the fixture for receiving light from a detached hidden light source.

According to the invention, the method further comprises the step of using a detached hidden light source for supplying light to a plurality of fixtures.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications. Such relationships, if any, between similar elements in the same or different figures will become apparent throughout the specification, including, if applicable, in the claims and abstract.

Figure 1A:
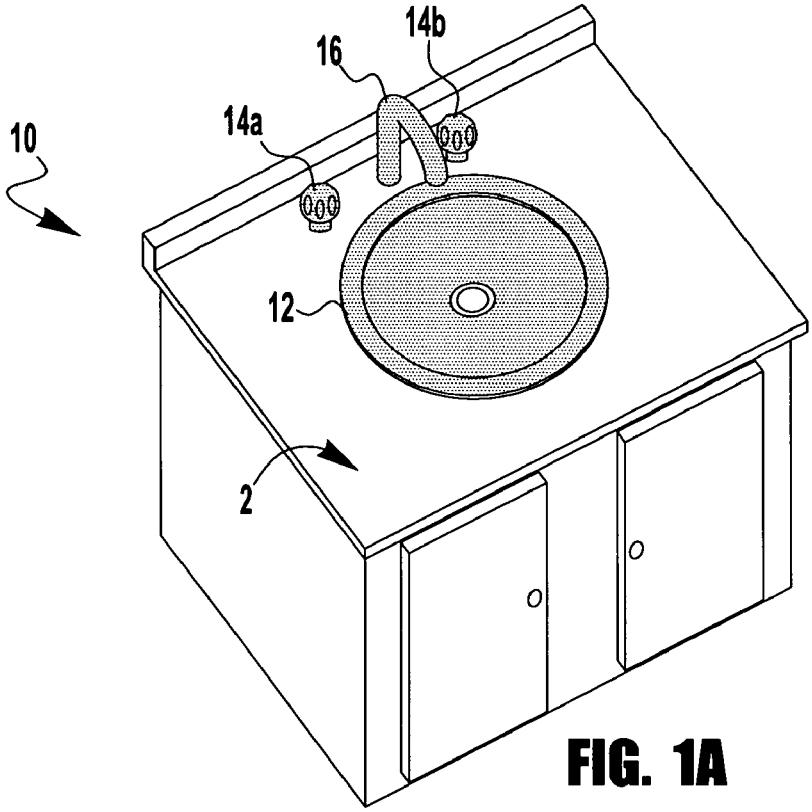
Figure 1B:
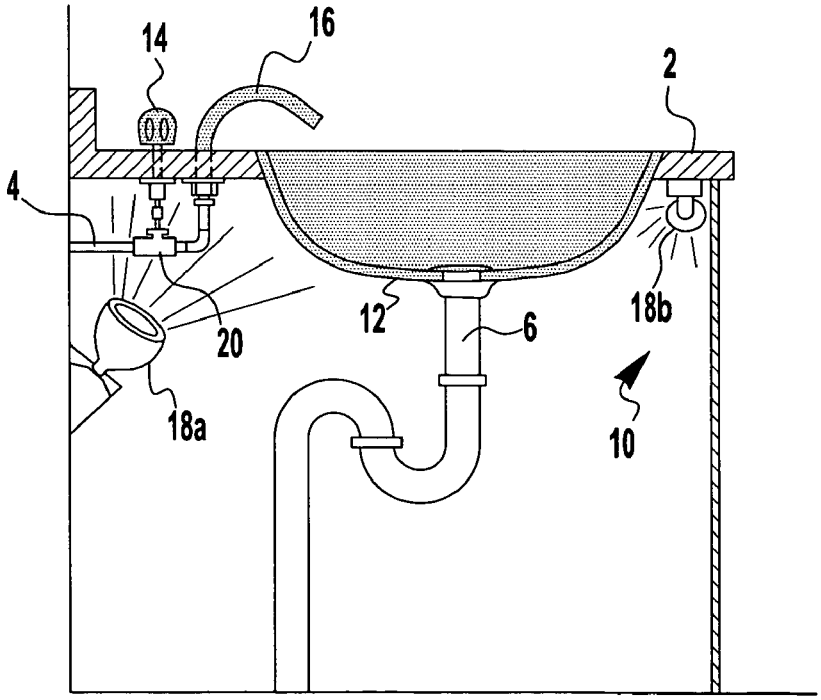
Figure 3B:
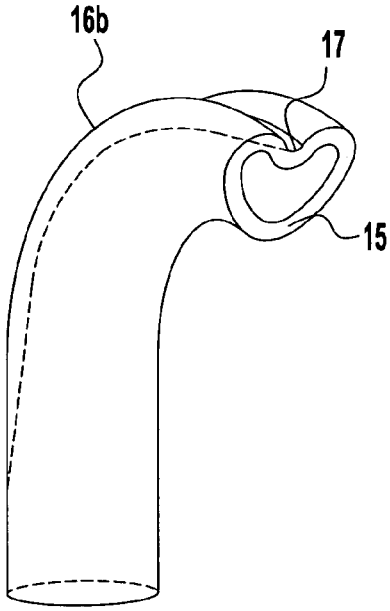
Figure 3A:
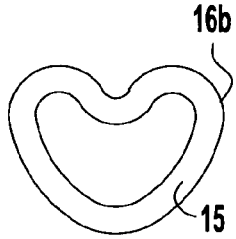
Figure 3C:
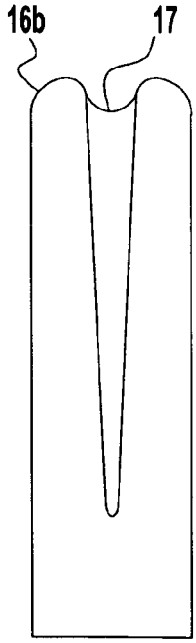
Figure 2:
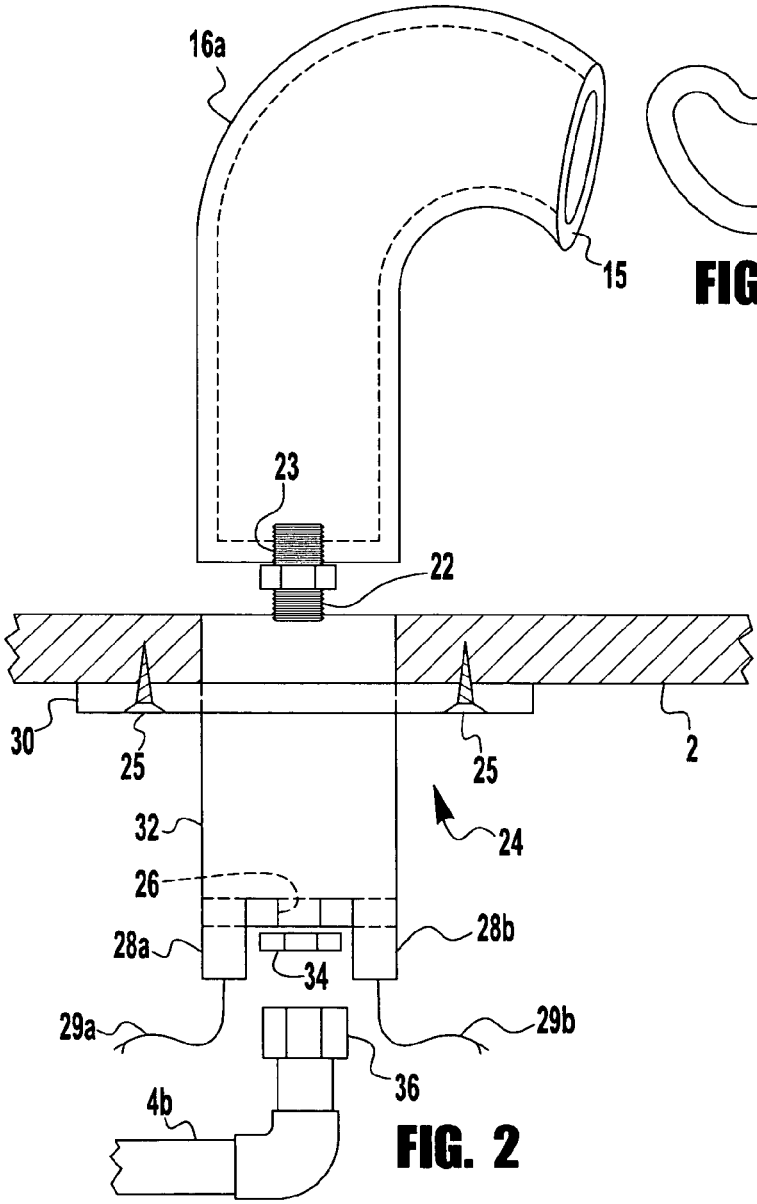
Figure 4A:
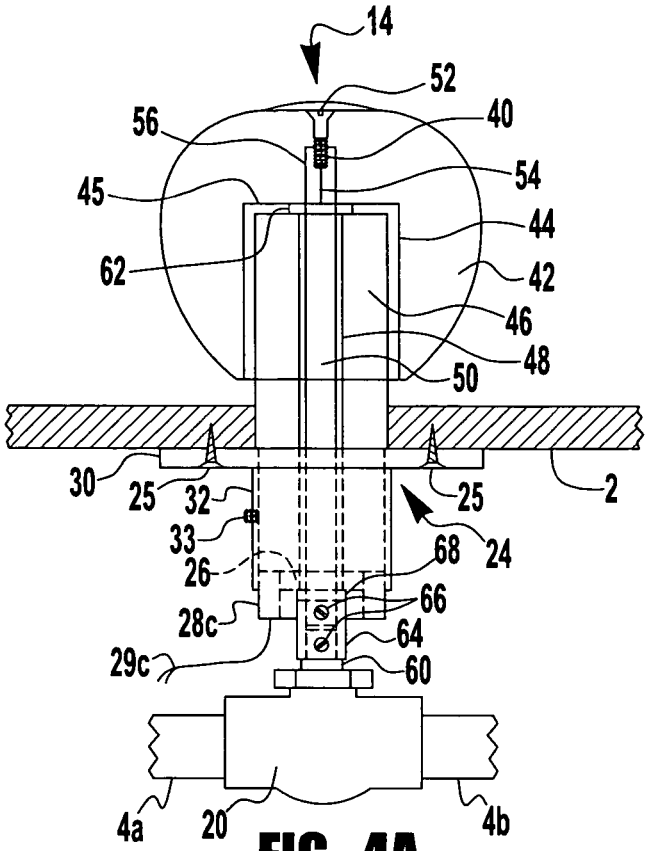
Figure 4B:
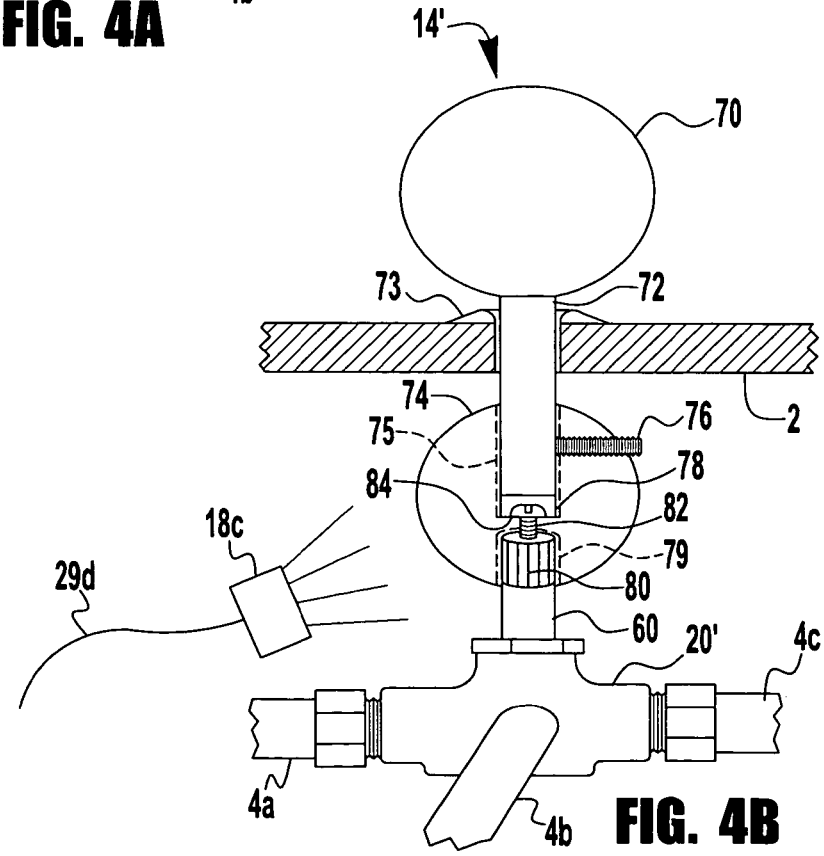
Figure 5:
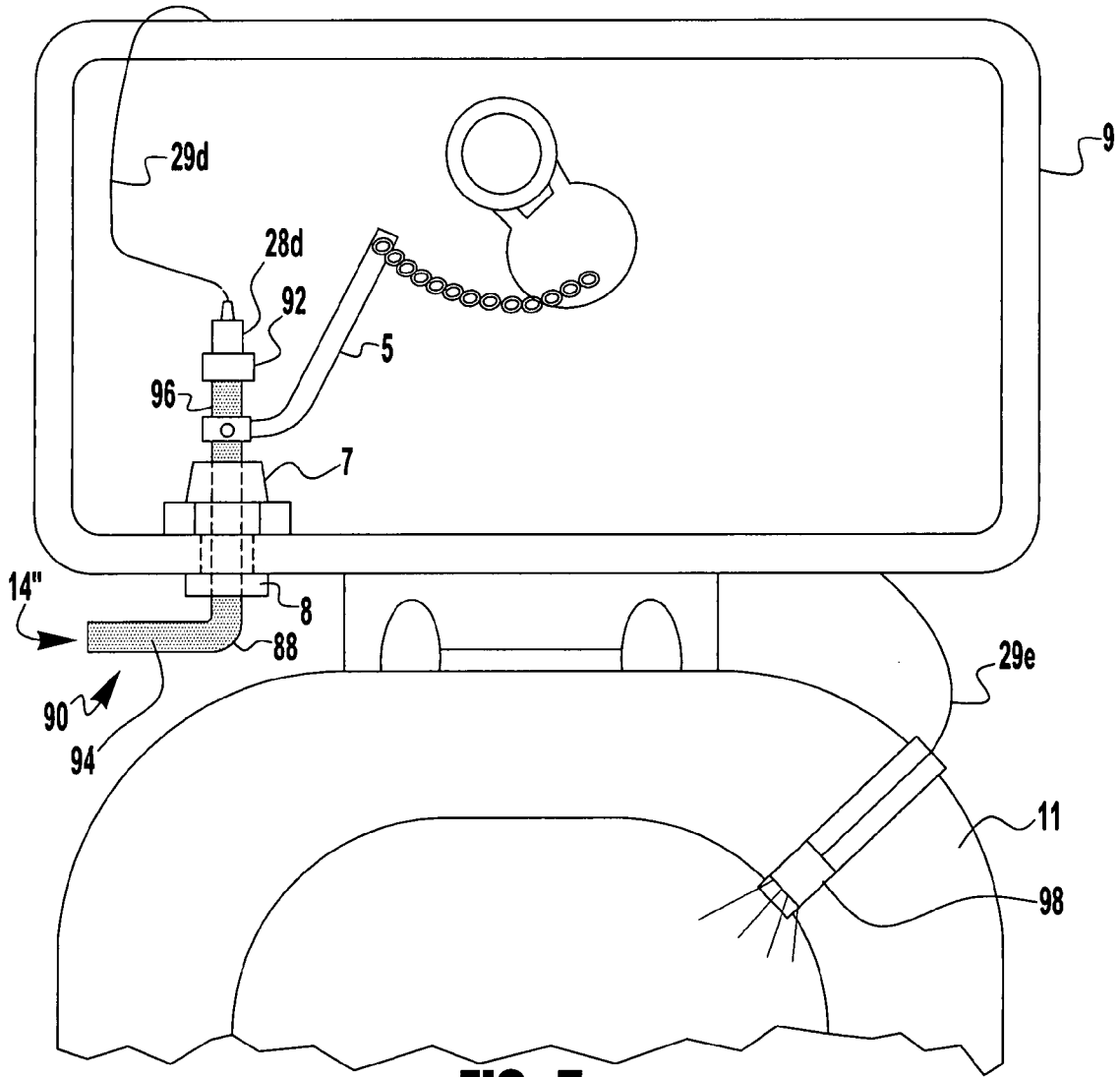
Figure 6:
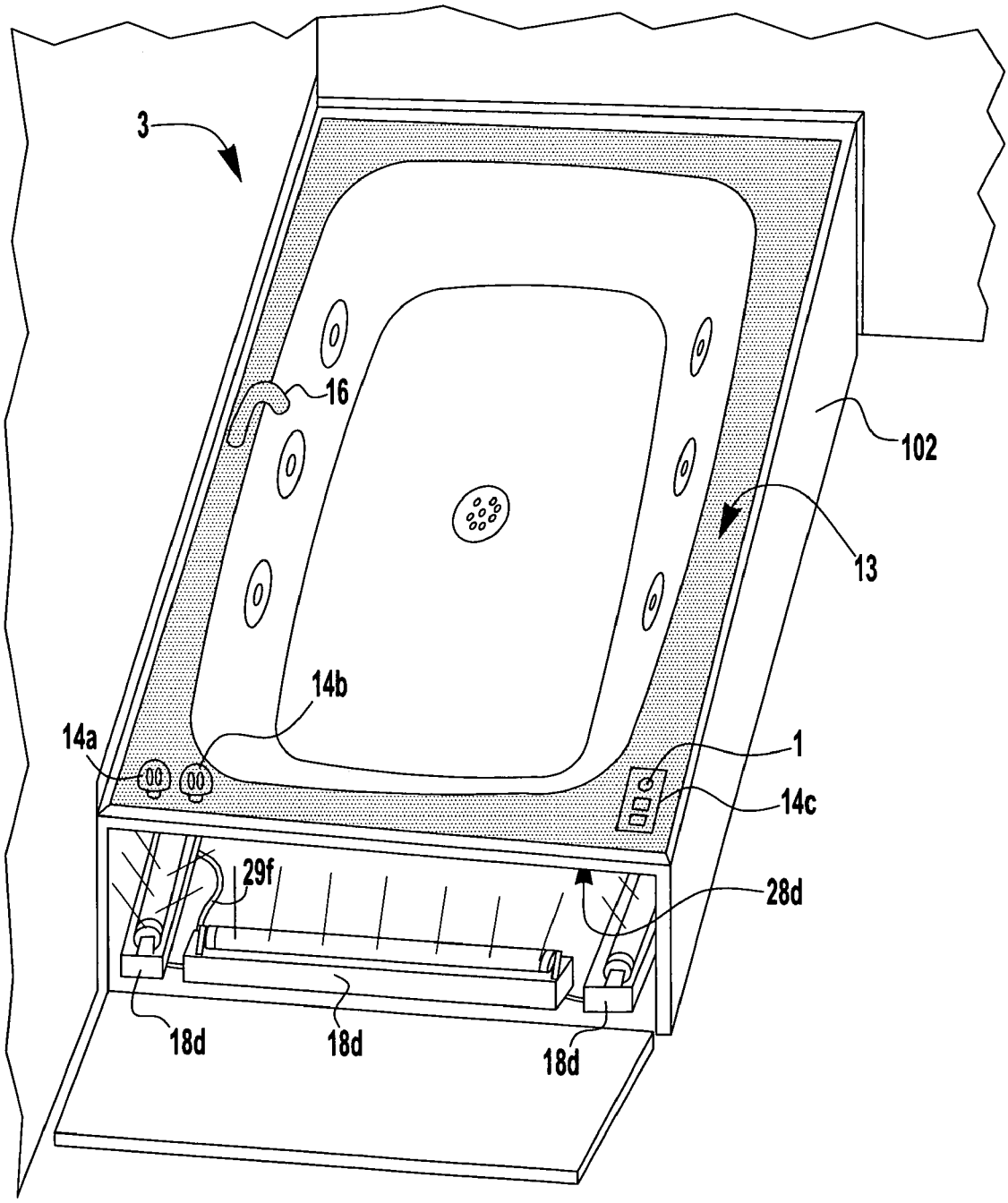

The structure, operation, and advantages of the present preferred embodiment of the invention will become further apparent upon consideration of the following description taken in conjunction with the accompanying drawings, wherein:

FIG. 1A is a top perspective view of a bathroom or lavatory vanity with illuminated plumbing fixtures shown by dotted shading, according to the invention;

FIG. 1B is a side cutaway view of the vanity of FIG. 1A with illuminated plumbing fixtures shown by dotted shading, according to the invention;

FIG. 2 is an exploded side view of an illuminated spout and its mounting apparatus, according to the invention;

FIG. 3A is a view of a nozzle end of an alternative embodiment of an illuminated spout, according to the invention;

FIG. 3B is a perspective view of the alternative illuminated spout of FIG. 3A, according to the invention;

FIG. 3C is a back view of the alternative illuminated spout of FIG. 3A, according to the invention;

FIG. 4A is a side view of an illuminated control and its mounting apparatus, using an attached light source, and attached to a single control valve, according to the invention;

FIG. 4B is a side view of an illuminated control and its mounting apparatus, using a detached light source, and attached to a dual control valve, according to the invention;

FIG. 5 is a top view of a toilet tank (cover removed) and a part of a toilet bowl (seat removed) illustrating a bent rod illuminated control shown by dotted shading, and an exterior clip-on light source for the opaque bowl, according to the invention; and FIG. 6 is a top perspective view of a tub embodiment of a vessel with a front access door opened, illustrating illuminated fixtures, shown by dotted shading, including a vessel top trim, spout, and controls, according to the invention.

DETAILED DESCRIPTION OF THE INVENTION

FIGS. 1A and 1B show an embodiment of the inventive illuminated plumbing fixtures wherein a sink bowl 12 (vessel), a faucet spout 16, and faucet controls (knobs 14*a* and 14*b*, collectively referred to as controls 14) are mounted on (fixedly mounted relative to), and extending outward from, a fixed mounting surface (countertop 2) and are illuminated by light shining outward from within or from behind the fixtures 12, 14, 16 as indicated by dotted shading. Thus the inventive illuminated plumbing fixtures (e.g., 12, 14, 16) glow pleasantly, especially in an otherwise dark or dimly lit bathroom, and can serve as either attractive "night lights" (functional lighting), or as elegant, sensual mood lighting.

The source of light is hidden beneath a countertop 2 of the vanity cabinet 10 (i.e., mounted inward from a mounting surface 2 of the illuminated plumbing fixture 12, 14, 16). FIG. 1B is a side view inside the cabinet 10 showing two examples of light sources 18: one is an incandescent flood light 18*a*, and another is a fluorescent light 18*b*. Many different sources of light can be adapted for the practice of this invention. In this example, the light sources 18 are separate from the fixtures 12, 14, 16 that are being illuminated. Due to its large exposed surface area, the bowl 12 that is made of a light transmitting (transparent or translucent) material (e.g., milky blue colored tempered glass), is easily lighted by general, non-directed lighting inside the cabinet (e.g., the fluorescent light 18*b*, which could advantageously be circular and arranged around the bottom of the bowl 12). The controls 14 and spout 16 are also light transmitting (e.g., Lucite) but have a smaller exposed area within the cabinet 10 and therefore may need a more directed light source (e.g., the floodlight 18*a*). The spout 16 and its control(s) 14 are supplied by conventional plumbing lines 4 (e.g., copper pipe), and each one of the controls 14 is coupled to a conventional valve 20 for operation thereof. Similarly, the sink bowl 12 has a conventional drain pipe arrangement 6. The sink bowl 12 is one form of vessel for fluid dispensed by the spout 16 under the control of the faucet knob(s) (control(s)) 14.

Referring now to FIGS. 2-3C, embodiments of illuminated spouts 16 are shown in detail along with a hidden illuminating light source embodiment that is an attached light source 28. A first spout 16*a* is a hollow bent rod, i.e., a hollow tube bent to dispense water into the sink bowl (e.g., illuminated bowl or vessel 12), and maintains an essentially round cross-section throughout its length. A second spout 16*b* is also a hollow tube bent to direct water into the sink bowl 12, but the cross-section shape varies from circular at its base to being indented around the bend to form a roughly heart shaped cross-section at its end (see FIG. 3A). The various spout embodiments 16*a*, 16*b* are collectively referred to as (illuminated) spouts 16 as described hereinabove.

A method of mounting the spout 16 on a countertop 2 is illustrated in FIG. 2. A mounting bracket 24 is preferably made of an opaque material (e.g., metal), and has a tubular receiving tube 32 with a flange 30 that is affixed under the countertop 2 by screws 25. First and second attached light sources 28*a* and 28*b*, respectively (28 collectively), are relatively compact light sources that direct light upward when attached to the bottom of the receiving tube 32. For example, the attached light sources 28 are LEDs that are powered through first and second supply wires 29*a* and 29*b*, respectively. The mounting bracket 24 has an inside diameter that closely fits ihe outside diameter of the spout 16 such that the spout 16 is firmly held in position on the countertop 2 rather than wobbling. Of course, a suitable size hole is cut through the countertop 2, and a trim ring (not shown) may be used to cover the edge of the countertop hole. At the intake end of the spout 16 is a threaded intake hole 23, and a coupling 22 (preferably translucent nylon) is sealingly screwed into the intake hole (e.g., using pipe threads and suitable sealant). The protruding end of the coupling 22 has straight threads that fit through a bottom hole 26 in the bracket 24, and mate with a lock nut 34 and a compression fitting 36.

For installation of the spout 16, the bracket 24 is affixed under the countertop 2 with the receiving tube 32 aligned with a suitable hole in the countertop 2. The coupling 22 is sealingly screwed into the spout's intake hole 23, and the spout 16 is inserted down into the bracket 24 until it bottoms out. The locknut 34 is firmly attached to the coupling 22, which should be protruding through the bracket's bottom hole 26, thereby holding the spout 16 firmly in place. Finally, the compression fitting 36 is used to operatively attach a plumbing outlet line 4*b* to the spout 16 by sealingly screwing onto the straight threads of the coupling 22.

It can be seen that once the spout 16 is installed in the bracket 24, the light emitted by the attached light sources 28 is piped upward by the spout 16 until it can escape through the sides of the spout 16 above the countertop 2, and/or be directed to shine outward from the nozzle end 15 of the spout 16. As is known in the art of light pipes, various illumination effects can be achieved by treatments of the fixture including, for example, coating, polishing or frosting portions of the outside and inside surfaces of the spout 16 including its nozzle end 15. Further light pipe effects can be achieved by controlling the wall thickness of the spout 16, etc. A preferred embodiment of the illuminated spout 16 has treatments such that the entire surface exposed above the countertop 2 emits light from the light source (e.g., attached light source 28) that is hidden beneath the countertop 2.

Referring now to FIG. 4A, a first embodiment of an illuminated control 14 is shown in detail along with a hidden illuminating light source embodiment that is an attached light source 28. A mounting bracket 24 is preferably made of an opaque material (e.g., metal), and has a tubular receiving tube 32 with a flange 30 that is affixed under the countertop 2 by screws 25. A large area attached light source 28*c* (e.g., an annular ring shaped electroluminescent panel) directs light upward when attached to the bottom of the receiving tube 32. The attached light source 28*c* is powered through supply wires 29*c*. The mounting bracket 24 has an inside diameter that closely fits the outside diameter of the control 14 such that the control 14 is firmly held in position on the countertop 2 rather than wobbling. Of course, a conventional faucet control hole is cut through the countertop 2, and a trim ring (e.g., bushing 73 in FIG. 4B) may be used to cover the edge of the countertop hole.

The embodiment of illuminated control 14 that is illustrated in FIG. 4A is a faucet knob that is turned to control the flow of water through a single water valve 20 that has an intake line 4*a* and an outlet line 4*b* leading to a faucet spout (e.g., illuminated spout 16). The plumbing lines 4*a*, 4*b*, and the water valve 20 are of conventional design (e.g., copper and brass) with a rotatable valve stem 60 extending upward. The illuminated control 14 comprises a control stem 50 (preferably light transmitting) that is coupled at one end to the valve stem 60 by a coupling 64, and is removably attached at the other end to a light transmitting knob 42. For example, the control stem 50 is a round Lucite rod with a square stem tip 54 that has a threaded hole 40. The coupling 64 overlaps the valve stem 60 and the control stem 50 and is removably attached to each, for example with set screws 66. The square stem tip 54 mates with a square hole 56 in the knob 42 and is removably held in place by a screw 52 that is preferably light transmitting (e.g., a nylon screw). Many other functionally equivalent methods should be apparent for attaching the control stem 50 to the knob 42. For example, the stem 50 and knob 42 could be molded as a single plastic part. For example, the stem 50 could be permanently fused (e.g., solvent bonding) to the knob 42.

The illuminated control 14 further comprises a hollow support column 46 that is also light transmitting. For example, the support column 46 and the knob 42 are both made of Lucite. A round channel 48 inside of the support column 46 rotatably holds the control stem 50. Similarly, a round cavity 44 in the bottom of the knob 42 is sized to allow close fitting rotation of the knob 46 around the support column 46. Although the knob cavity 44 is shown as a fairly deep cavity, any depth of cavity 44 is contemplated, including zero depth wherein a cavity bottom 45 is flush with the bottom of the knob 42 and the column 46 extends upwards to abut the cavity bottom 45. Regardless of the cavity depth, a small clearance space is allowed between the top of the column 46 and the cavity bottom 45, thereby allowing free turning of the knob 42 relative to the column 46. The knob 42 is close-fitted to adjacent surfaces of the support column 46 in order to maximize light transmission from the column 46 to the knob 42. To facilitate smooth turning of the knob 42, a thin, light transmitting knob washer 62 (e.g., nylon, Teflon™) is optionally positioned around the control stem 50 between the cavity bottom 45 and the support column 46.

For installation of the control 14, the bracket 24 is affixed under the countertop 2 with the receiving tube 32 aligned with a suitable hole in the countertop 2. The support column 46 is inserted down into the bracket 24 until it bottoms out, and a set screw 33 is tightened to hold it in place. The control stem 50 is screwed together with the knob 42 such that the stem tip 54 is firmly engaged with the mating hole 56 in the knob 42. If present, the optional washer 62 is placed on the control stem 50 and the coupling 64 is placed on the valve stem 60. Then, with a base washer 68 positioned on top of the coupling 64, the control stem 50 is inserted down through the support's inside channel 48, through the bracket's bottom hole 26, through the base washer 68 and into the coupling 64, until the attached knob 42 rests lightly on the support column 46 (with the knob washer 62 between, if present). The coupling 64 is now lifted to press the base washer 68 between the coupling 64 and the bracket 24, and then the coupling screws 66 are tightened to hold everything in place as well as coupling the control stem 50 to the valve stem 60.

It can be seen that once the control 14 is installed in the bracket 24, the light emitted by the attached light source(s) 28 is piped upward by the support column 46 and the control stem 50, then transmitted through adjacent surfaces to the knob 42 whereupon it can escape through the external sides of the knob 42 above the countertop 2. As is known in the art of light pipes, various illumination effects can be achieved by treatments of the fixture including, for example, coating, polishing or frosting portions of the outside and inside surfaces of the control 14 including its knob 42, support column 46, and control stem 50. Further light pipe effects can be achieved by controlling the separations between adjacent surfaces, varying the knob shape and sculpturing, etc. A preferred embodiment of the illuminated control 14 has treatments such that the entire surface exposed above the countertop 2 emits light from the light source (e.g., attached light source 28) that is hidden beneath the countertop 2.

A variation of this embodiment of the control 14 would be to fuse together, or otherwise make as one solid piece, the knob 42, the support column 46, and the control stem 50. The washer 62 would be moved down to the bottom of the support column 46 and the set screw 33 would not be used. Thus the combined knob/column/stem 42/46/50 could be turned in the bracket 24 for operation of the valve 20.

Referring now to FIG. 4B, a second embodiment of an illuminated control 14' is shown in detail along with a hidden illuminating light source embodiment that is an detached light source 18, for example a light source 18*c* is a small directed light (e.g., a miniature reflector lamp) that is mounted to be aimed at a light collecting portion of the control 14'. The detached light source 18*c* is powered through supply wires 29*d*.

A second embodiment of illuminated control 14' that is illustrated in FIG. 4B is a faucet knob that is turned to control the flow of water through a dual water valve 20' that has a cold intake line 4*a*, a hot intake line 4*c*, and an outlet line 4*b* leading to a faucet spout (e.g., illuminated spout 16). The plumbing lines 4*a*, 4*b*, 4*c*, and the dual water valve 20' are of conventional design (e.g., copper and brass) with a valve stem 60 extending upward. As is conventional, the valve stem 60 is rotated to control the hot-cold mixing proportion, and the valve stem 60 is push/pulled in/out to control the water mixture flow rate.

The second embodiment illuminated control 14' comprises a control shaft 72, a knob 70 and a light gathering ball 74, all of which are light transmitting (e.g., acrylic). The knob 70 (shown as a round ball shape) is fused to the shaft 72 which extends radially outward from the knob 70. In addition to gathering light, the light gathering ball 74 also serves as a coupling between the control shaft 72 and the dual water valve 20'. Therefore the light gathering ball 74 has a radial stem receiving hole 79 that is fluted for mating with a fluted tip 80 of the valve stem 60; and, on the other side of a partition 84, has a second radial shaft receiving hole 75 that extends in the diametrically opposite direction for mating with the control shaft 72.

For installation of the second control 14', the dual water valve 20' is fixedly installed (e.g., using copper plumbing and/or a bracket, not shown) under the countertop 2 with the valve stem 60 aligned with a suitable hole in the countertop 2. Preferably a combination bushing and trim ring 73 is press-fit into the countertop hole. The bushing 73 (preferably metal) is dimensioned for a close fit around the control shaft 72 for preventing excessive wiggling of an installed control 14', while at the same time allowing free sliding and rotating movement of the control shaft 72. The stem receiving hole 79 of the light gathering ball 74 is press fit onto the valve stem 60 and held attached with a screw 82 that passes through a hole in the partition 84 and screws into a mating threaded hole in the stem tip 80. Then, with the valve stem 60 pushed all the way down into the dual valve 20', the control shaft 72 is inserted down through the bushing 73 and down into the shaft receiving hole 75 until the knob 70 is at a suitable height above the countertop 2, and a set screw 76 is tightened to hold it in place. Thus the second control 14' is indirectly mounted on a fixed mounting surface (the countertop 2) in that the control 14' passes through a close fitting bushing 73 in the countertop 2 and is attached to the dual valve 20' that is mounted in a location that is fixed relative to the bushing 73 and the countertop 2.

It can be seen that once the second control 14' is installed, the light gathering ball 74 collects light from the detached light source 18*c* and directs the light into the shaft 72, which in turn pipes the light up to the knob 70 whereupon the light can escape through the external sides of the knob 42 and the shaft 72 above the countertop 2. As is known in the art of light pipes, various illumination effects can be achieved by treatments of the fixture including, for example, coating, polishing or frosting portions of the outside and inside surfaces of the control 14 including its knob 70, control shaft 72, and light gathering ball 74. Further light pipe effects can be achieved by controlling the separations between adjacent surfaces, varying the knob and ball shape and sculpturing, etc. A preferred embodiment of the second embodiment of illuminated control 14' has treatments such that the entire surface exposed above the countertop 2 emits light from the light source (e.g., detached light source 18) that is hidden beneath the countertop 2.

A third embodiment of illuminated control 14" that is illustrated in FIG. 5 is a toilet flush handle 90 that is levered to operate a flush mechanism in a toilet tank 9 above a toilet bowl 11. The toilet and its flush mechanism are of conventional design including, for example, a flush arm 5 and a bushing 8 with locknut 7 for rotatably holding the flush handle 90 (i.e., attaching the handle 90 to a fixed mounting surface being the tank 9). The illuminated flush handle 90 is a light transmitting rod (e.g., Lucite) that is bent to one side to form a curved L shape for lever action, having a long straight shank 96 transitioning through an elbow 88 to a shorter leg 94 for the handle portion. For best transmission of light, the elbow 88 may be much more gently curved than a sharp ninety degree bend, and may in fact be a semi-circle in combination with the leg 94, i.e., more like a J shape; or could also be a quarter of a circle (a ninety degree circular arc), like a rounded L shape. The shank 96 passes through the bushing 8 into the tank 9, passes through the flush lever 5 (which is attached, for example by a set screw), and extends back to an end where a coupling 92 couples an attached light source 28*d* (e.g., an LED) to the shank 96. Preferably the coupling 92 is a resilient sleeve that entirely encloses the light source 28*d* and its connection to wires 29*d*, thereby making the light source 28*d* water resistant.

The shank 96 of the toilet control 14" (flush handle 90) collects light from the attached light source 28*d* and pipes the light out of the tank 9 around the elbow 88 and to the leg 94 whereupon the light can escape through the external sides of the flush handle 90 outside the toilet tank 9 wherein the light source 28*d* is hidden. As is known in the art of light pipes, various illumination effects can be achieved by treatments of the fixture including, for example, coating, polishing or frosting portions of the outside and inside surfaces of the control 14" including its shank 92, elbow 88, and leg 94. Further light pipe effects can be achieved by controlling the separations between adjacent surfaces, varying the flush handle 90 shape and sculpturing, etc. A preferred embodiment of the third embodiment of illuminated control 14" has treatments such that the entire surface exposed outside of the tank 9 emits light from the light source (e.g., attached light source 28*d*) that is hidden within the tank 9.

It should be apparent that the controls 14, 14', and 14" could be used interchangeably in the different applications. In particular, the two faucet control embodiments 14 and 14' could employ bent rods (e.g., 90) for lever handles in place of the knobs 42, 70 that are illustrated.

An auxiliary light 98 (e.g., an LED) with electric wires 29*e* can be clipped onto the rim of the toilet bowl 11 for providing general lighting inside the (opaque ceramic) toilet bowl 11.

Referring now to FIG. 6, another embodiment of illuminated plumbing fixtures is a vessel in the form of a tub 3 that could be a standard bathtub, a hot tub, a whirlpool tub (as illustrated), etc. In this example, the illuminated fixture comprises trim 13 around the top of the tub 3. The tub 3 could be entirely light transmitting for complete illumination, or as illustrated, a portion 13 of the tub 3 is light transmitting, e.g., the top trim surface of the tub 3. For example, the tub is molded fiberglass that is mostly opaque except for the top trim surface 13 which is translucent. Fluorescent lights 18*d* are hidden within a tub enclosure 102 (i.e., a mounting surface for the tub), powered by wires 29*f*, for providing a general, non-directed light source 18. The fluorescent lights 18*d* surround the tub 3 within the enclosure 102. An interesting effect can be obtained by using "black light" (UV) fluorescent tubes for the light source 18*d*. An alternative, attached light source 28*d* is an electroluminescent panel that is cut to shape and adhered under the light transmitting portion 13 of the tub 3.

For added effect, an illuminated spout 16 and illuminated controls 14*a*, 14*b* can be added as shown. Another type of illuminated control 14 is the face plate 14*c* of the whirlpool electrical controls 1, wherein at least portions of the face plate 14*c* are light transmitting. For example, the face plate 14*c* could be opaque except for light transmitting lettering that labels the tub controls 1, and/or light transmitting decorative lines. Thus the light transmitting portions of the face plate 14*c* would glow with the light from the hidden light source 18*d* or 28*d* that is transmitted through the tub trim 13 to the face plate 14*c*.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. Illuminated plumbing fixtures comprising:

a fluid conveying spout mounted on a fixed mounting surface, the spout extending outward from the mounting surface; and a bracket that comprises:

a receiving tube for holding a one of the illuminated plumbing fixtures;

a flange at a first end of the receiving tube for attaching it inward of the mounting surface;

a through hole at a second end of the receiving tube, distal from the first end; and a hidden light source that is attached to the second end of the receiving tube radially outward from the through hole for passing light from the attached hidden light source into the receiving tube; wherein:

the spout passes through the mounting surface to be held within the receiving tube;

the spout comprises a light transmitting material; and the spout has a shape and surface treatment such that light from the hidden light source is emitted outward of the mounting surface.

2. The illuminated plumbing fixtures of claim 1, further comprising:

a control for the spout, the control also being mounted on the mounting surface, and extending outward from the mounting surface; and a hidden light source mounted inward from the mounting surface; wherein:

the control comprises a light transmitting material; and the control has a shape and surface treatment such that light from the hidden light source is emitted outward of the mounting surface.

3. The illuminated plumbing fixtures of claim 2, wherein:

the control emits light from substantially all of the control's surface that is exposed outward of the mounting surface.

4. The illuminated plumbing fixtures of claim 2, farther comprising:

a vessel for the spout, the vessel also being mounted on the mounting surface, and having a surface that is exposed outward of the mounting surface; and a hidden light source mounted inward from the mounting surface; wherein:

at least a portion of the vessel comprises a light transmitting material; and the vessel has a shape and surface treatment such that light from the hidden light source is emitted outward of the mounting surface from the light transmitting portion of the vessel's surface that is exposed outward of the mounting surface.

5. The illuminated plumbing fixtures of claim 4, wherein:

one hidden light source supplies light for two or more of the illuminated plumbing fixtures that are mounted on the mounting surface.

6. The illuminated plumbing fixtures of claim 2, wherein:

the control passes through the mounting surface into another bracket that rotatingly holds the control within its receiving tube.

7. The illuminated plumbing fixtures of claim 2, further comprising a light gathering ball that comprises:

a light transmitting solid ball inward of the mounting surface; and a shaft receiving hole extending diametrically from the surface of the ball to a point at least part way through the ball, for holding a one of the illuminated plumbing fixtures; wherein:

the hidden light source is detached from the light gathering ball but is mounted where it supplies light to a portion of the light gathering ball.

8. The illuminated plumbing fixture of claim 1, wherein:

the spout emits light from substantially all of the spout's surface that is exposed outward of the mounting surface.

* * * * *